United States Patent [19]

Osano et al.

[11] 4,352,347

[45] Oct. 5, 1982

[54] ELECTRONIC CONTROL SYSTEM FOR A CARBURETOR

[75] Inventors: Hisashi Osano, Koganei; Takuro Morozumi, Hachioji, both of Japan

[73] Assignees: Fuji Jukogyo Kabushiki Kaisha, Tokyo; Nissan Motor Co., Ltd., Yokohama, both of Japan

[21] Appl. No.: 174,379

[22] Filed: Aug. 1, 1980

[30] Foreign Application Priority Data

Aug. 2, 1979 [JP] Japan ..... 54-98916
Aug. 2, 1979 [JP] Japan ..... 54-98917

[51] Int. Cl.[3] ..... F02M 7/18
[52] U.S. Cl. ..... 123/440; 123/179 G
[58] Field of Search ..... 123/489, 440, 179 G; 261/39 E

[56] References Cited

U.S. PATENT DOCUMENTS 3,763,831 10/1973 Orlando ..... 261/39 E
3,949,551 4/1976 Eichler et al. ..... 123/489 X
4,201,735 5/1980 Byam ..... 261/39 E

*Primary Examiner*—Tony M. Argenbright
*Attorney, Agent, or Firm*—Martin A. Farber

[57] ABSTRACT

An electronic control system for a carburetor of an internal combustion engine having an induction passage, engine cooling water and a device supplies an air-fuel mixture to the induction passage. A converter converts the temperature of the engine cooling water to a first voltage signal. A choke valve is disposed in the induction passage and a bimetal actuates the choke valve. A positive temperature coefficient heater heats the bimetal. A heater circuit produces a second voltage signal dependent on the resistance of the positive temperature coefficient heater. An air-fuel ratio controller controls the air-fuel ratio of the mixture supplied by the air-fuel mixture supply device. A calculating circuit combines the voltage signals from the converter and the heater circuit respectively and produces an electronic control for controlling the air-fuel ratio control. The electronic control is responsive to the output electric signals of the calculating circuit such that the air-fuel ratio is controlled to a value providing satisfactory cold engine operating performance.

9 Claims, 3 Drawing Figures

ELECTRONIC CONTROL SYSTEM FOR A CARBURETOR

BACKGROUND OF THE INVENTION

The present invention relates to an electronic control system for a carburetor of an internal combustion engine and more particularly to a means for controlling the air-fuel ratio of a mixture to a proper value during the warm-up operation of the engine.

Feedback control systems for controlling the air-fuel ratio are known in the internal combustion engine emission control system art with the three-way catalyst, as disclosed in U.S. Pat. No. 4,132,199. In one of such systems, an oxygen sensor is provided for sensing the oxygen content of the exhaust gases for producing an output voltage as an indication of the air-fuel ratio of the mixture supplied to the engine. An electronic control circuit is provided for actuating an on-off type electromagnetic valve dependent on the output voltage of the oxygen sensor to control the air-fuel ratio of the mixture to the stoichiometric air-fuel ratio. The output voltage of the oxygen sensor varies according to the temperature of the sensor device. More particularly, when the temperature is below 300° C., the output voltage is too low to operate the electronic control circuit for controlling the air-fuel ratio.

In a conventional electronic control system, the duty ratio (the ratio of the duration of valve open period to one on-off cycle of the on-off type electromagnetic valve) is fixed to a predetermined duty ratio during the cold engine operation for providing a lean air-fuel mixture, and, on the other hand, an automatic choke device is provided to correct the lean air-fuel mixture provided by the system to a proper air-fuel ratio dependent on the engine temperature for improving the operability of the cold engine.

The automatic choke device is adapted to close the choke valve by a bimetal dependent on the engine temperature so that the engine may be started in the cold. The choke valve is progressively opened as the engine temperature rises. In the automatic choke device, a slight variation in flow area of the choke valve causes a great variation of the air-fuel ratio. Therefore, it is difficult to control the air-fuel ratio to a desirable value by the automatic choke device.

SUMMARY OF THE INVENTION

The object of the present invention is to provide an electronic control system for a carburetor which can correct the air-fuel ratio during the cold engine operation to a value providing satisfactory cold engine performance, whereby operability of the engine can be improved and effective emission control may be accomplished.

According to the present invention, there is provided an electronic control system for a carburetor of an internal combustion engine having an induction passage, engine cooling water and a device which supplies an air-fuel mixture to the induction passage. A convertor converts the temperature of the engine cooling water to a first voltage signal. A choke valve is disposed in the induction passage, and a bimetal actuates the choke. A positive temperature coefficient heater heats the bimetal. A heater circuit produces a second voltage signal dependent on the resistance of the positive temperature coefficient heater. An air-fuel ratio controller controls the air-fuel ratio of the mixture supplied by the air-fuel mixture supply device, a calculating circuit combines the voltage signals from the convertor and the heater circuit respectively. An electronic control device controls the air-fuel ratio controller, the electronic control means being responsive to output electric signals of the calculating circuit such that the air-fuel ratio is controlled to a value providing satisfactory cold engine operating performance.

The present invention will be described by way of example with reference to the accompanying drawings.

DETAILED DESCRIPTION OF THE PREFERRED EMBODIMENT

Figure 1:
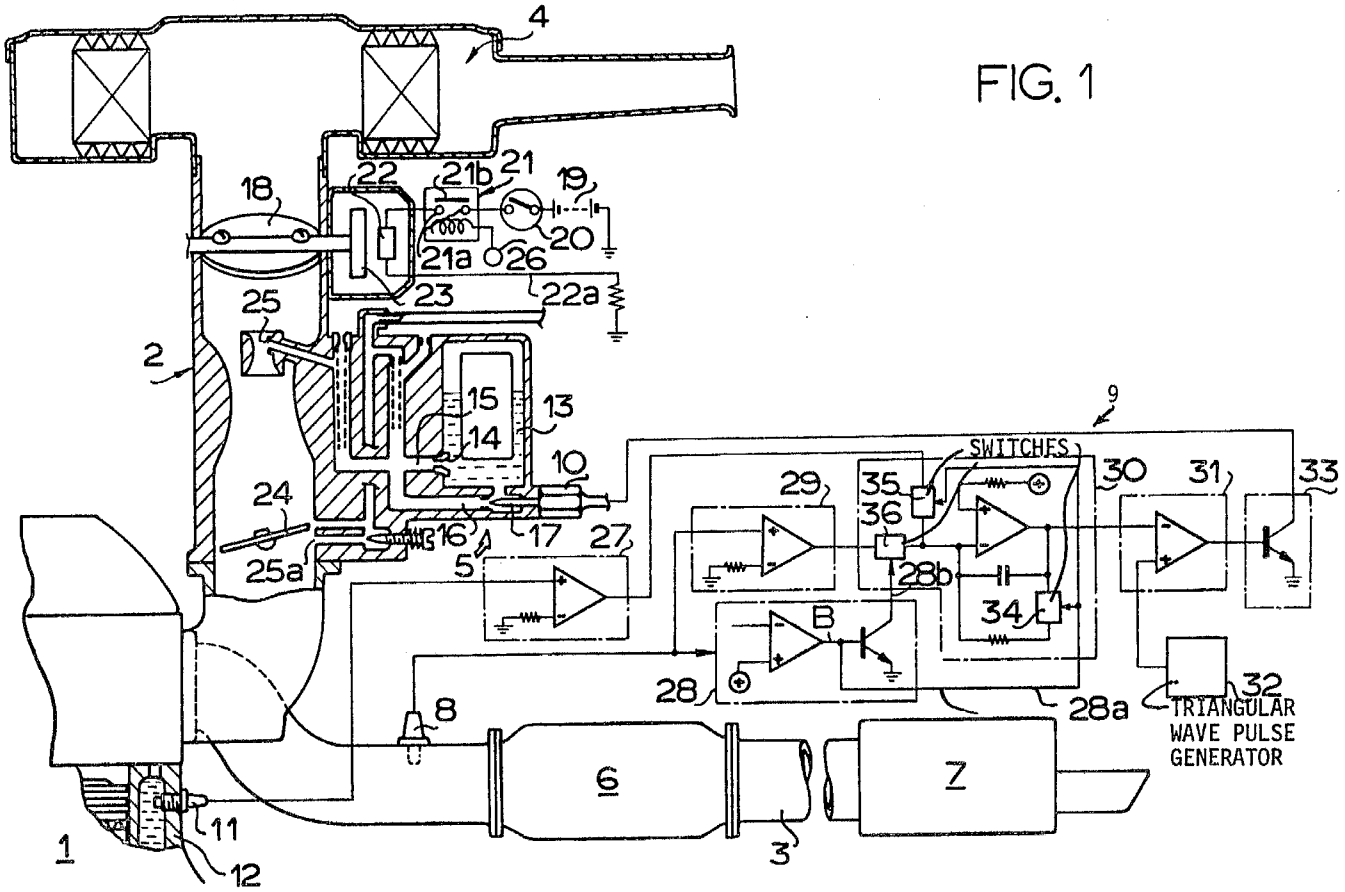
FIG. 1 is a schematic view of an air-fuel ratio control system according to the present invention.

Referring to FIG. 1, an internal combustion engine 1 is shown having an induction passage 2, and an exhaust passage 3. An air cleaner 4 and a carburetor 5 are provided in the induction passage 2 and a three-way catalytic converter 6 and a muffler 7 are provided in the exhaust passage 3. An oxygen sensor 8 is provided in the exhaust pipe upstream of the three-way catalytic converter 6 for detecting the oxygen content of the exhaust gases. The output signal of the oxygen sensor 8 is fed to an electronic control circuit 9 for actuating an on-off type electromagnetic valve 10 which controls the fuel supply flow rate to a main nozzle 25.

A thermistor 11 is provided on a water jacket 12 for providing a voltage which is dependent upon the temperature of the cooling water. The thermistor 11 is connected to the electronic control circuit 9.

The carburetor 5 comprises a float chamber 13, a main fuel jet 14, a main fuel passage 15 and a by-pass fuel passage 16. The by-pass fuel passage 16 is intermittently closed and opened by the plunger 17 or needle member of the on-off type electromagnetic valve 10. An automatic choke device comprises a positive temperature coefficient (PTC) heater 22 and a bimetal 23 which is heated by the PTC heater 22. The PTC heater 22 is connected to a battery 19 through a relay 21 and an ignition key switch 20. The resistance of the PTC heater 22 is low in the cold and increases with increasing temperature. Thus, in the cold, the choke valve 18 which is operatively connected to the bimetal 23 for pivoting is closed and is progressively opened by the operation of the bimetal 23 as the temperature increases.

A throttle valve 24 and the main nozzle 25 of the carburetor 5 are disposed in the induction passage 2. A conventional alternator 26 is connected to an induction coil of the relay 21.

Figure 3:
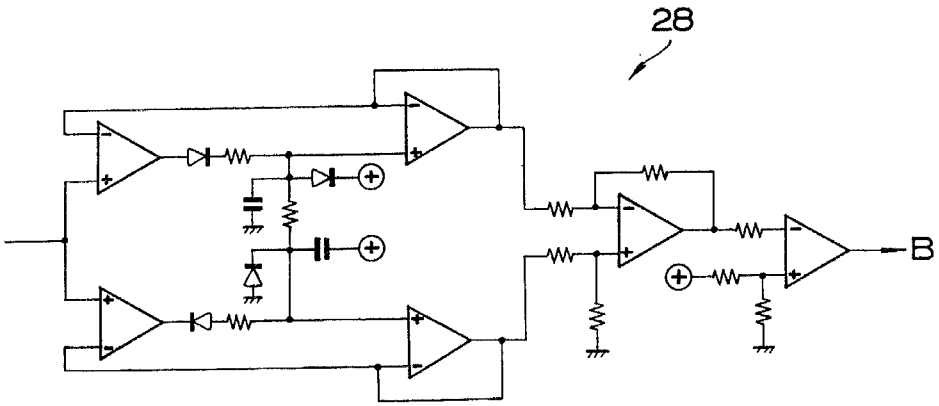
FIG. 3 is an electric circuit of a control start judgement circuit.

The electronic control means 9 comprises a thermistor voltage detecting and processing circuit 27, a control start judgement circuit 28, a judgement circuit 29 connected to an integration circuit 30 and a comparing circuit 31 which in turn is connected to a triangular wave pulse generator 32 and a valve driving circuit 33. The oxygen sensor 8, the judgement circuit 29, the integration circuit 30, the comparator 31, the driving circuit 33 and the valve 10 constitute a well known feedback control system. FIG. 3 shows an example of the control start judgement circuit 28. The circuit 28 produces an output signal at the output B when the amplitude of the output voltage of the oxygen sensor 8 exceeds a predetermined value.

In operation, when the ignition key switch 20 is closed, the engine is started and the alternator 26 is operated.

Thus, the relay 21 is operated to close the contacts 21*a* via bridge 21*b* to operate the PTC heater 22 via the battery 19. Thus, the bimetal 23 is heated so that the choke valve 18 is opened. Then the temperature increases in the heater 22 and as a result, the resistance of the heater 22 increases, whereby the opening speed of the choke valve is decreased.

The control start judgement circuit 28 acts to elevate the output signals from the oxygen sensor 8. When the voltage applied from the oxygen sensor 8 is less than a predetermined level, the judgement circuit 28 operates to generate a high level signal on the line 28*a* and a low level signal on the line 28*b*. The high level signal is fed to the gate of an integration disabling switch 34 and to the gate of an engine parameter input switch 35 which is connected between the thermistor voltage detecting circuit 27 and the input of the integration circuit 30. The low level signal is fed to the gate of an error signal input switch 36 which is disposed between the judgement circuit 29 and the input of the integration circuit 30. Thus, the switches 34 and 35 are closed and the switch 36 is opened, so that the integration circuit 30 does not act as the integration circuit, but as the operational amplifier. Thus, the integration circuit 30 is operated by the control of the thermistor voltage detecting and processing circuit 27 to produce an output therefrom. The output of the integration circuit 30 is compared in the comparing circuit 31 with triangular wave pulses applied from the pulse generator 32.

The output signal of the integration circuit 30 slices the triangular wave pulses in the comparing circuit 31, so that on-off square wave pulses are produced. The width of each square wave pulse varies according to the output signal of the integration circuit 30. The on-off pulses are fed to the on-off valve 10 through the driving circuit 33.

In cold engine operation, the temperature of the cooling water is low. Accordingly, the resistance of the thermistor 11 is high and the voltage of the signal applied to the integration circuit 30 from the circuit 27 is high. The integration circuit 30 operates to produce on-off pulse signals having a small pulse duty ratio by such a high input voltage. Thus, the on-off valve 10 is actuated with a small pulse duty ratio, so that the flow rate of the fuel through passage 16 to the main nozzle 25 and to the slow ports 25*a* is decreased, thereby providing a lean air-fuel mixture in the induction passage 2. Consequently, it is possible to correct the air-fuel ratio provided by the automatic choke device. Therefore, an excessive rich air-fuel ratio may be prevented.

During warming up, as the temperature of the cooling water increases, the resistance of the thermistor 11 decreases causing a decrease in the voltage applied to the integration circuit 30. As a result, the pulse duty ratio is increased, so that a rich air-fuel mixture can be provided. Thus, it will be seen that the air-fuel ratio of the mixture may be controlled to a desirable air-fuel ratio by the electronic control circuit 9 and the thermistor 11 during the warm-up operation of the engine. Therefore, the cold engine operation may be properly performed with a corrected air-fuel mixture.

After the engine has been warmed up, when the voltage from the oxygen sensor 8 reaches the predetermined voltage level, the output voltage of the control start judgement circuit 28 is inverted. Consequently, the switches 34 and 35 are opened and the switch 36 is closed, and the integration circuit 30 becomes responsive to the output signal of the judgement circuit 29. The judgement circuit 29 operates to determine whether the signal from the oxygen sensor 8 is higher or lower than a predetermined desired level to produce a judged output voltage.

Thus, the electronic control circuit 9 controls the duty ratio of the on-off valve 10 to provide the stoichiometric air-fuel ratio.

Figure 2:
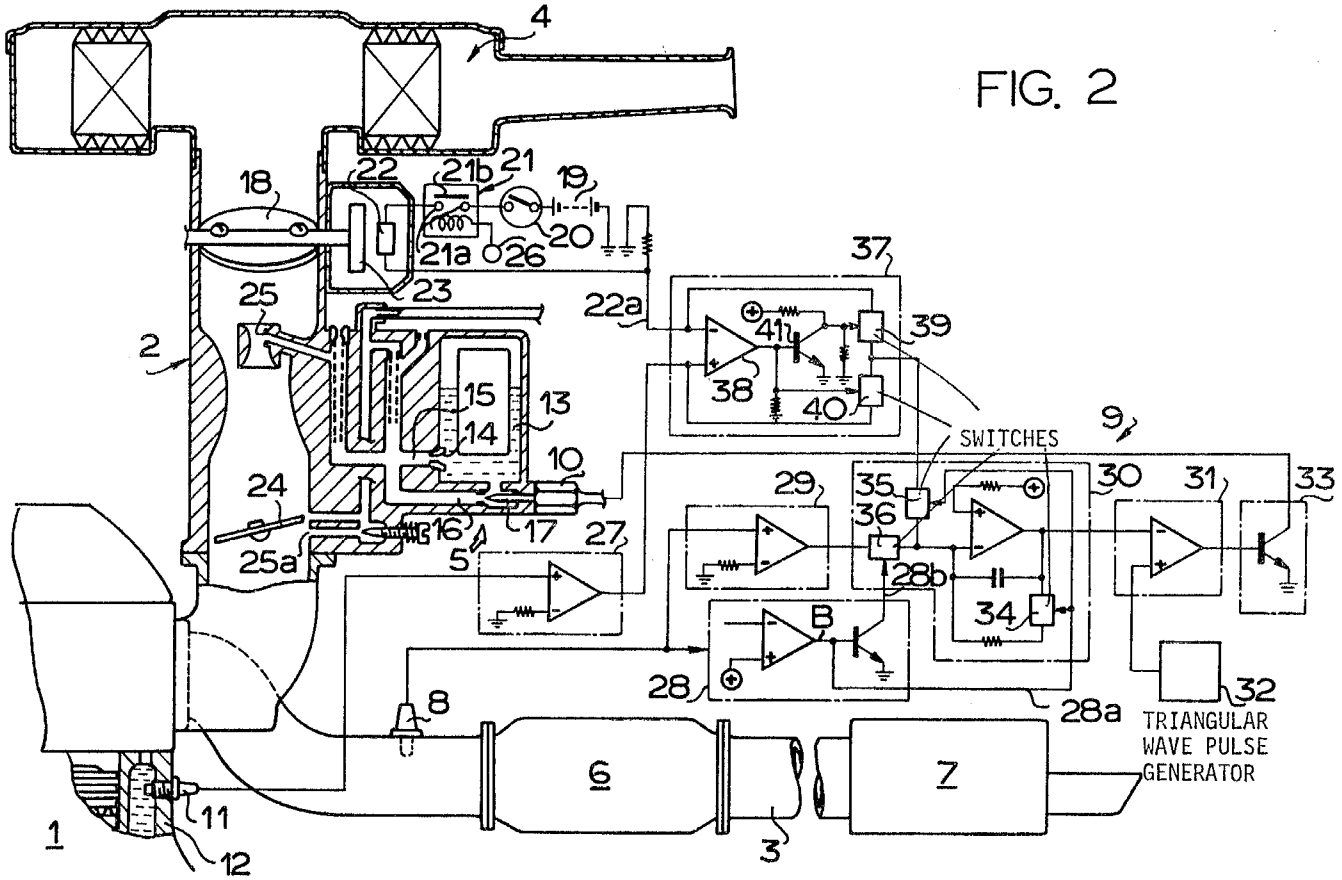
FIG. 2 is a schematic view showing another embodiment of the present invention.

Referring to FIG. 2 showing another embodiment of the present invention, the system is similar to the system of the previous embodiment of FIG. 1. The same parts as the previous embodiment are identified with the same numerals as FIG. 1. In the system of the second embodiment, the circuit of the PTC heater 22 and the thermistor voltage detecting circuit 27 are connected to a calculating circuit 37 of the electronic control circuit 9. The calculating circuit 27 comprises an operational amplifier 38, a transistor 41 connected with its base to the extent of the operational amplifier 38, a switch 39 actuated by the transistor 41 and a switch 40 actuated by the output of the amplifier 38. The output of the calculating circuit 37 is connected to the integration circuit 30 via the switch 35. In the cold engine operation at the beginning of the starting of the engine, the output voltage of the circuit 27 is higher than the voltage applied from the PTC heater 22. Therefore, the output voltage of the operational amplifier 38 is high and the transistor 41 is turned on, so that the switch 39 is opened and the switch 40 is closed. Consequently, the output voltage of the circuit 27 is applied to the integration circuit 30 via the switches 40 and 35. As temperatures of the engine and the PTC heater 22 increase, the resistance of the thermistor 11 decreases, and resistance of the PTC heater increases. When the voltage on line 22*a* from the PTC heater becomes higher than the thermistor voltage, the output voltage of the amplifier 38 is inverted. Thus, the switch 39 is closed and the switch 40 is opened. Consequently, the voltage from the PTC heater is applied via line 22 and switch 39 to the integration circuit 30. Thus, the system actuates the on-off type electromagnetic valve 10 by the signal from the calculating circuit 37 in the cold. In accordance with the second embodiment, since the system operates to control the air-fuel ratio by the signal combining the voltages due to the thermistor 11 and the PTC heater 22, the cold engine operation may be improved more than the previous embodiment.

It will be understood that on-off type electromagnetic valves may be provided in the air bleed passage and/or the air by-pass to control the air-flow rate instead of controlling the fuel flow rate, and that different exhaust gas component detecting means other than an oxygen sensor and different actuators other than an on-off type electromagnetic valve may be employed.

From the foregoing, it will be observed that the present invention provides an electronic control system which may control the air-fuel ratio in dependency on the temperature increase of the cooling water thereby providing satisfactory cold engine performance and a desirable reduction of harmful constituents of the exhaust gases.

What is claimed is:

1. An electronic control system for a carburetor of an internal combustion engine having an induction passage, engine cooling water and means for supplying an air-fuel mixture to said induction passage, comprising means for converting the temperature of the engine cooling water to a first voltage signal, a choke valve disposed in said induction passage, bimetal means for actuating said choke valve, means comprising a positive temperature coefficient heater for heating said bimetal means, circuit means for producing a second voltage signal dependent on the resistance of said positive temperature coefficient heater, air-fuel ratio control means for controlling the air-fuel ratio of the mixture supplied by said air-fuel mixture supplying means, a calculating circuit means for combining said voltage signals from said converting means and said circuit means, respectively, and electronic control means for controlling said air-fuel ratio control means, said electronic control means being responsive to output electric signals of said calculating circuit means such that the air-fuel ratio is controlled to a value providing satisfactory cold engine and warming up operating performance.

2. The electronic control system defined in claim 1 further comprising means for detecting the content of exhaust gases and producing an output signal dependent thereon, said electronic control means further for being responsive to the output signal from said detecting means and for controlling said air-fuel ratio control means when the engine has been warmed-up.

3. The electronic control system according to claim 1 or 2 wherein said detecting means is an oxygen sensor.

4. The electronic control system according to claim 1 or 2 wherein said air-fuel ratio control means comprises an on-off type electromagnetic valve, and said electronic control means further for producing an on-off pulse for operating said air-fuel ratio control means.

5. The electronic control system according to claim 1 or 2, wherein said calculating circuit means includes switch means for operatively transmitting only said first voltage signal to said electronic control means during start of a cold engine operation and during a subsequent warming up for operatively transmitting only said second voltage signal to said electronic control means.

6. The electronic control system according to claim 5, wherein said calculating circuit means includes an operational amplifier having inputs operatively connected to said circuit means and to said converting means, respectively, and an output connected to an input of said electronic control means via said switch means.

7. The electronic control system according to claim 6, wherein said switch means includes a first switch and a second switch having outputs connected to said input of said electronic control means, switching gates connected in relatively inverted electrical manner to the output of said operational amplifier, and inputs respectively connected to said inputs of said operational amplifier.

8. The electronic control system according to claim 7, wherein said calculating circuit means includes an inverting transistor having a base connected to said output of said operational amplifier and an output connected to one of said switches.

9. The electronic control system according to claim 5, further comprising a processing circuit is connected between said converting means and one of said inputs of said calculating circuit means.

* * * * *